US007694450B2

(12) United States Patent
Keng

(10) Patent No.: US 7,694,450 B2
(45) Date of Patent: Apr. 13, 2010

(54) REMOVABLE OPTICAL SIGHT MOUNT ADAPTED FOR USE WITH M14, M1A AND SIMILAR RIFLES AND METHOD FOR REMOVABLY ATTACHING AN OPTICAL SIGHT TO A RIFLE

(76) Inventor: Da Keng, 875 Wharton Dr. SW., Atlanta, GA (US) 30336

( * ) Notice: Subject to any disclaimer, the term of this patent is extended or adjusted under 35 U.S.C. 154(b) by 236 days.

(21) Appl. No.: 11/703,843

(22) Filed: Feb. 8, 2007

(65) Prior Publication Data

US 2008/0072471 A1 Mar. 27, 2008

Related U.S. Application Data

(60) Provisional application No. 60/771,020, filed on Feb. 8, 2006.

(51) Int. Cl.
*F41G 1/38* (2006.01)

(52) U.S. Cl. ..... 42/124; 42/127; 42/128

(58) Field of Classification Search ..... 42/124, 42/127, 128

See application file for complete search history.

(56) References Cited

U.S. PATENT DOCUMENTS 4,845,871 A * 7/1989 Swan ..... 42/127
5,276,988 A * 1/1994 Swan ..... 42/127
5,680,725 A * 10/1997 Bell ..... 42/127
6,295,754 B1 * 10/2001 Otteman et al. ..... 42/124
6,606,813 B1 * 8/2003 Squire et al. ..... 42/90
7,272,904 B2 * 9/2007 Larue ..... 42/127
7,481,016 B2 * 1/2009 Gonzalez ..... 42/127
2004/0000083 A1 * 1/2004 Grant, Jr. ..... 42/112
2005/0241212 A1 * 11/2005 Swan ..... 42/127
2005/0252060 A1 * 11/2005 Gonzalez ..... 42/90
2006/0123686 A1 * 6/2006 Larue ..... 42/127
2006/0179703 A1 * 8/2006 Leatherwood ..... 42/124
2006/0207156 A1 * 9/2006 Larue ..... 42/127
2007/0033852 A1 * 2/2007 Adams ..... 42/124
2008/0000134 A1 * 1/2008 Peterson ..... 42/124
2008/0034638 A1 * 2/2008 Spuhr ..... 42/127

* cited by examiner

*Primary Examiner*—Bret Hayes
*Assistant Examiner*—Michael D David
(74) *Attorney, Agent, or Firm*—J. A. McKinney, Jr.

(57) ABSTRACT

A removable optical sight mount adapted for use with a military-style rifle such as an M1A provides a centrally aligned support projecting well to the rear for use with sights having very limited eye relief. The removable sight advantageously uses a three point lock up or attachment to the rifle, the three points being (1) an elongated longitudinal tenon engaging a groove on the left side of the rifle secured with a fastener and cammed into tight engagement with the groove, (2) a transverse rear guide block, and (3) an adjustable front set screw that, when tightened, bears on the rifle receiver's crown.

19 Claims, 14 Drawing Sheets

32
30
48
36
38
31A
40

32
30
31
50
36
38

32
78
33
60
79
39
36
38

48'
50
48'
36
40'

39
36
38
60
33
79

31B
50
31A
36

REMOVABLE OPTICAL SIGHT MOUNT ADAPTED FOR USE WITH M14, M1A AND SIMILAR RIFLES AND METHOD FOR REMOVABLY ATTACHING AN OPTICAL SIGHT TO A RIFLE

CROSS-REFERENCE TO RELATED APPLICATIONS

This application claims priority, under 35 U.S.C. §119(e), to U.S. Provisional Application No. 60/771,020 filed Feb. 8, 2006, the entire contents of which are incorporated herein by reference.

BACKGROUND OF THE INVENTION

1. Field of the Invention

The present invention relates to firearm sights and, more specifically, to a method and apparatus for removably attaching a mount for an optical or telescopic sight to a rifle.

2. Discussion of the Prior Art

Military and competition shooters have come to appreciate the simple construction and reliable operation of rifles having Garand-style rolling block operation. Such Rifles include the M1 Garand (in 30-06 caliber), the M1A (in .308 or 7.62 NATO caliber) and the select fire M14 (also in .308 or 7.62 NATO caliber).

The M14 is still used for certain military applications, in part because of the significant power advantage provided by the .308 or 7.62 NATO caliber projectiles, when compared to the standard issue .223 or 5.56 NATO caliber projectiles used in the M16 rifle or M4 carbine. Unfortunately, many of the modern M16/M4 attachments and accessories are not readily used with an M1A or M14 pattern rifle, since those rifles were originally configured for use solely with iron or mechanical sights. When special circumstances (e.g., a need for sniper rifles) mandated mounts for telescopic sights, armorers could not simply screw traditional sporting or Weaver™ style rails above the M1 Garand's rolling-block action receiver.

Armorers eventually developed mounts for use with optically sighted M1s; the first version was known as the M1C and utilized a telescopic sight held in place by a commercial (Griffin and Howe) "rail system" mount having a mounting method devised to avoid drilling and tapping the receiver and using a barrel collar which accepted a scope mount that attached utilizing a knurled knob on the mounting collar. The rail system (or lever) telescope mount required that the receivers be shipped to Griffin and Howe to drill and tap the receiver before heat-treating. The heat treating process associated with drilling and tapping the receiver (for the Griffin and Howe system) delayed production and so few M1Cs were delivered for combat service during W.W.II. In an effort to avoid the heat treatment problems associated with drilling and tapping the M1 receivers, a second approach to scope mounting utilized a machine base fitted to the rear of the barrel with a pin. The scope was releasably mounted to the barrel base with a knurled screw tightened by hand. This approach avoided the necessity of heat treatment after drilling and tapping. These expensive and protracted procedures resulted in a telescopic mount of acceptable but not superior accuracy. When the M1A and M14 replaced the M1 Garand as the principal service rifle, many of the same mounting problems were also carried forward, since the newer rifles also used the rolling block action and receiver configuration.

This legacy now creates a number of new problems for armorers. Contemporary users of the M14 and M1A have sought to use modern optical sighting systems including, for example, the Trijicon ACOG (i.e., "Advanced Combat Optical Gunsight") optical sighting system, but there is not a practical way to releasably mount such modern optical devices to these older service rifles. The ACOG uses both tritium and fiber optic technology to illuminate a red circle reticle covering four minutes-of-angle (MOA), with a hollow center that covers 2 MOA. The ACOG sight is in use around the world by U.S. and coalition forces, and has been found to be very effective and rugged. The ACOG provides a relatively short one and one-half inches of eye relief and an eight millimeter exit pupil. Weighing about three-quarters of a pound with a flattop mount, the ACOG is compact and relatively light, while offering the durability needed in a combat sight. It offers much greater hit probability for most shooters, and is considered a lifesaver in low light combat situations. As a result, soldiers and marines have become accustomed to using the ACOG and similar optical devices on their service weapons.

There is a need, therefore, for a practical method and mount structure permitting a shooter to releasably mount modern optical devices to older service rifles, if they are to be used in combat.

OBJECTS AND SUMMARY OF THE INVENTION

Accordingly, it is a primary object of the present invention to overcome the above mentioned difficulties by providing a removable and centrally aligned mount for optical sights having limited eye relief.

It is also an object of this invention to provide a removable mount that does not require gunsmithing or permanent modification of the rifle.

Another object is to provide a removable mount adapted for use on a rifle having a rolling block action that can be installed by a user, removed, and then re-installed without causing a substantial change to the zero or aim point adjustment of the optical sight.

These advantages may be achieved individually and in combination, and it is not intended that the present invention be construed as requiring two or more of these advantages to be combined.

In the mounting apparatus and method of the present invention, a Picatinny-style rail's proximal end or tail is advantageously set much further back or proximally towards the shooter's face. That is necessary when using the ACOG because of its limited eye relief (i.e., about 1.5 inches).

As note above, an ACOG is optical sight which has, among other things, an illuminated reticle. The removable mount of the present invention places the ACOG's ocular lens closer to the shooter's eye. The ACOG optical sighting device has found a lot of favor recently because the shooter can keep both eyes open, providing a more natural way of aiming at live, human-size targets at close quarters in a real time situation where speed is everything.

The removable mount is intended to enhance that "both eyes open" rapid target acquisition characteristic that the ACOG sight offers, and so in order to mount the ACOG device closer to the shooter's face, the mount of the present invention differs significantly from the prior art.

The mount's base has a cantilevered rail segment extending rearwardly or proximally toward the shooter, preferably extending as far back as the receiver design of the M14/M1A will allow. When installed, the mount's proximal end is nearly touching the rifle's rear sight (i.e., the M-14 or M1A adjustable rear sight assembly's peep sight and surrounding protective ears projecting up and defining a rear boundary). Preferably, the rail portion of this mount does not interfere with the rifle's rear sight assembly.

The base of the mount has a horizontal longitudinal rectangular concave upper surface that acts as an upper support segment used to receive either the ACOG or alternatively, a Picatinny rail, providing a dual use mount. This mount is purpose built for the standard ACOG which has a bottom surface originally designed to fit the M-16 (M-16A1 or A2), in the carry handle.

The modified M-14 mount of the present invention receives the ACOG directly, and carries the ACOG low on the mount. The mount is purpose built for the ACOG, however, the mount can be converted to install a standard telescopic sight on a Picatinny rail. The Picatinny rail can support military or commercial scopes, night vision devices or a number of other accessories.

When installed, the mount partially occludes the path used for ordinary iron sight use and so is not ideally suited for unrestricted use of the M-1A iron sights. However, the mount has a quick release so that one can readily remove it and use the iron sights instead. The mount does permit limited use of the iron sights through the round sighting channel because the base of the peep channel in the ACOG housing is a rounded axial bore.

A knob screw and camming knob engage and retain the vertical side wall of the mount's base. The mount is releasably attached to the rifle by first removing the stripper clip guide from the receiver. The Picatinny tail block then has to be fitted (i.e., preferably filed down, or otherwise formed), since it is preferably initially a little bit oversized. Next one puts the mount on the rifle, attaching first and second spaced apart tail block retaining screws, to avoid interfering with that central sight channel.

Preferably, the tail block retaining screws are left slightly loose or not tightened fully and then the camming knob is placed against the mount and secured with the knob screw.

The camming knob is a side cam that provides a camming action and so as a user twists the knob's tab or handle, or the upwardly projecting knob bears against a slot in the sidewall of the base. The sidewall slot is not a square because it has radiused corners, and when a user screws in the side cam screw and then grasps the knob and rotates it one way or another, the base or body is forced back against the mount attachment point on the rifle's receiver. On the inside or backside of the mount's side plate, there is an inwardly projecting raised ridge tenon sized to engage a relief cut or longitudinal groove on the left side of the M14 receiver. The user pulls the mount up against the side of the receiver at the same time pulling upward and in on the groove to bite into the receiver. The base's tenon is rectangular in section and is longitudinally aligned so that it is roughly parallel to the rifle's bore and the tenon engages the groove in the side of the M14's receiver. By moving the camming eccentric member, one can first position the tenon within the receiver's groove, and then the user can snug the tenon up against the side of the receiver by tightening the camming screw. Next a hexagon socket set screw is tightened to exert force on the top of the mount, such that it forces the mount to bear down against the crown of the rifle's receiver.

When mounted and tightened down, the mount provides a multi-point lock up, three points being (1) on the left side of the rifle, tenon 60/camming bolt 36, (2) the stripper clip area where block retaining screws 46 secure guide block 50, and (3) the front screw 40, which bears on the receiver's crown, when tightened. The mount of the present invention provides a centrally aligned support placed well to the rear for use with sights having very limited eye relief, and so is especially well suited for use with the ACOG.

Other mounts not providing this centrally aligned rearward support are likely to require the shooter to place his or her head farther forward on the stock, where the abrupt rearward movement of recoil may cause an injury.

The above and still further objects, features and advantages of the present invention will become apparent upon consideration of the following detailed description of a specific embodiment thereof, particularly when taken in conjunction with the accompanying drawings, wherein like reference numerals in the various figures are utilized to designate like components.

DESCRIPTION OF THE PREFERRED EMBODIMENT

Figure 1:
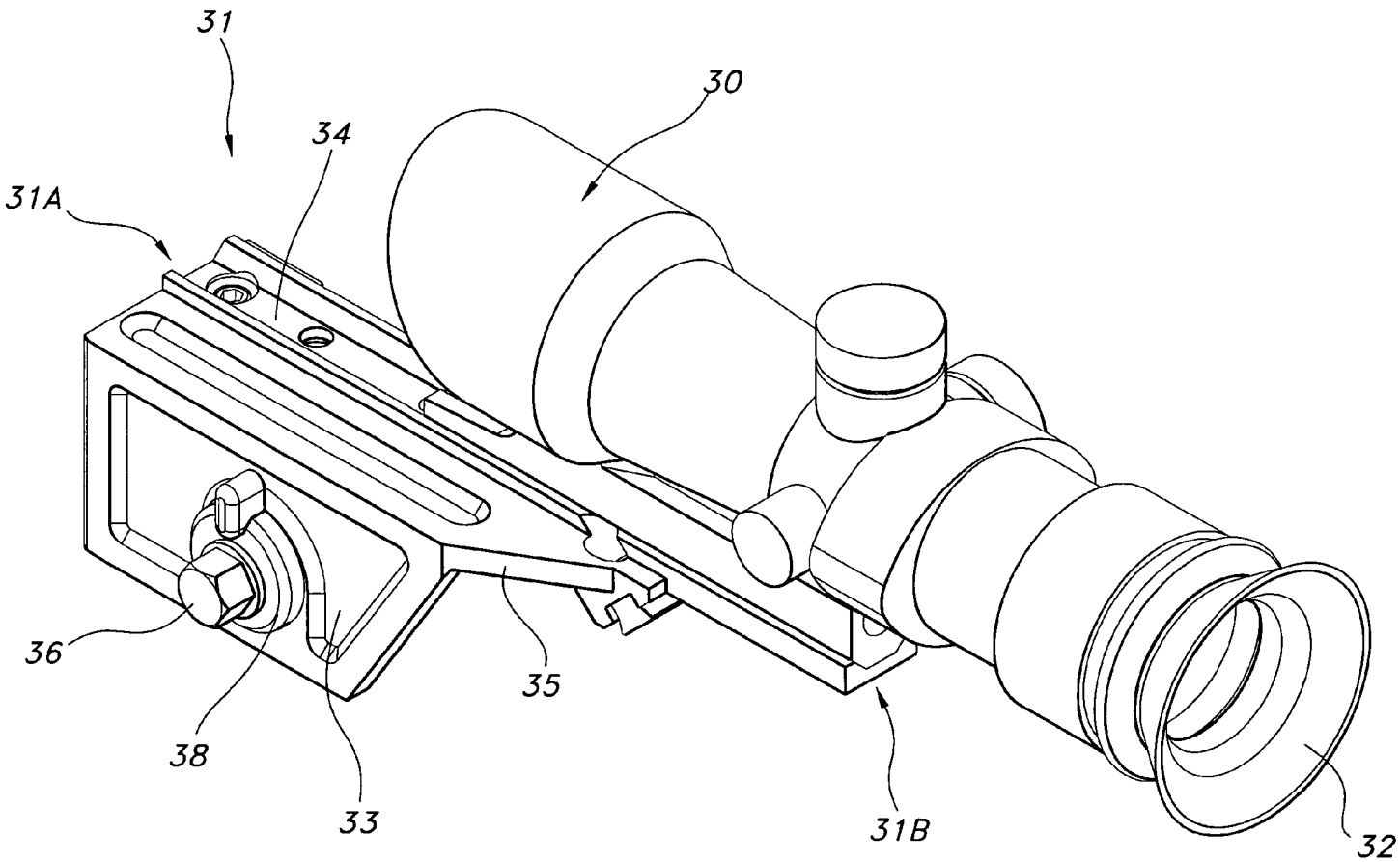
FIG. 1 is a perspective view illustrating the left-side of the mount assembly, with an ACOG optical sight or scope, in accordance with the present invention.

Referring to FIGS. 1 thru 17E, illustrating the mount apparatus 31 and method of the present invention, the mounting is advantageously set much further back or proximally towards the shooter's face and eyes. As noted above, a centrally aligned rearwardly projecting mounting surface 34 is necessary when using certain optical sights such as the ACOG 30 because of their very short eye relief (e.g., about 1.5 inches).

The removable mount 31 of the present invention places the ACOG's ocular lens 32 closer to the shooter's eye. The ACOG optical sighting device 30 has found a lot of favor recently because the shooter can keep both eyes open, providing a more natural way of aiming at live, human-size targets at close quarters in a real time situation where speed is everything. The removable mount 31 is intended to enhance that "both eyes open" rapid target acquisition characteristic that the ACOG sight offers, and so in order to mount the ACOG device closer to the shooter's face the mount of the present invention differs from the prior art.

FIG. 1 is a perspective view illustrating an assembled mount 31 and an exemplary optical sight or scope 30 (e.g., the ACOG), separate from a rifle on which they would be mounted during use. The mount 31 has a cantilevered rail segment extending rearwardly or proximally toward the shooter, preferably extending as far back as the receiver 72 will allow (best shown in FIG. 5).

Figure 2:
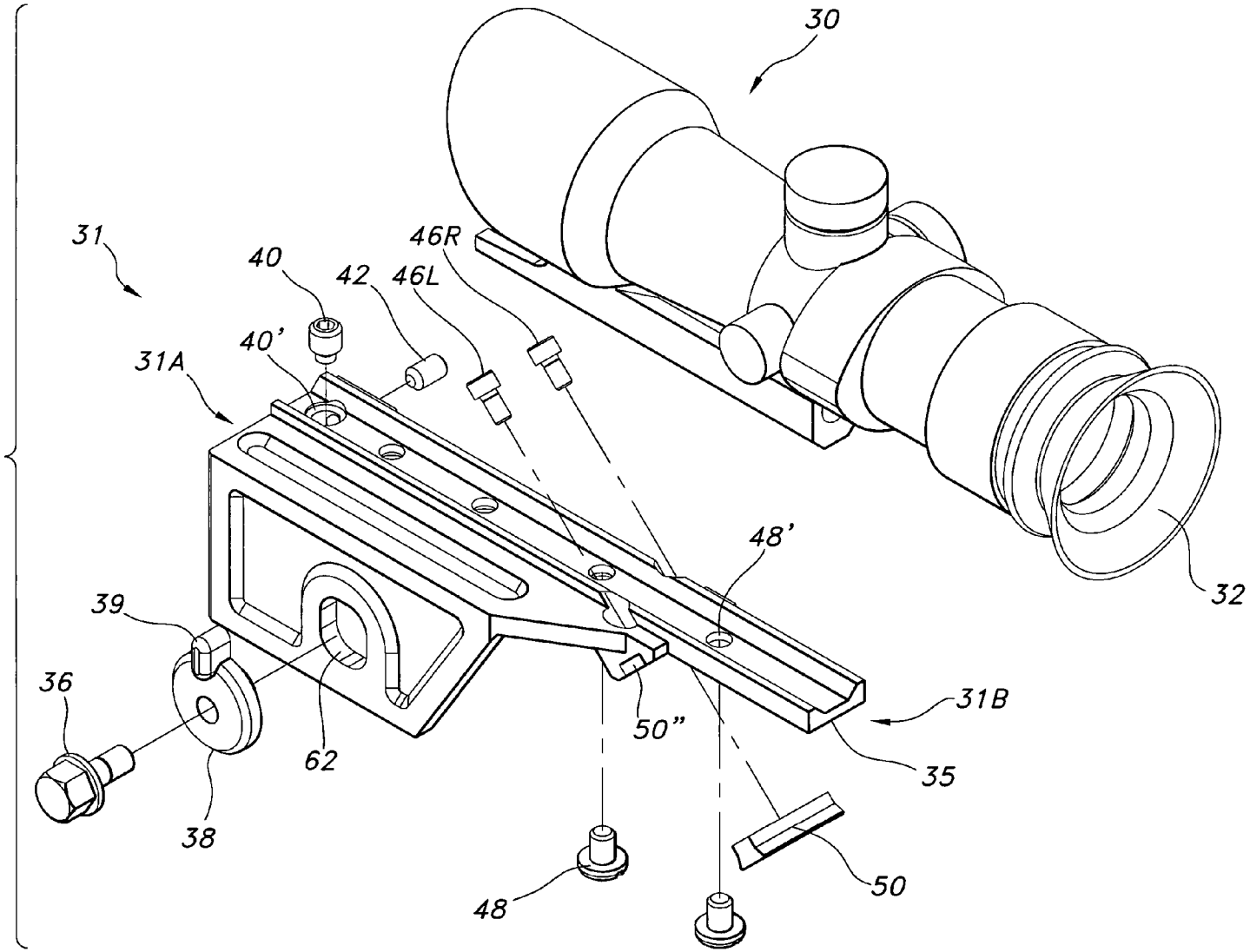
FIG. 2 is an exploded perspective view illustrating of the mount assembly of FIG. 1, with scope, in accordance with the present invention.

FIG. 2 is an exploded view of mount 31 of FIG. 1. Mount 31 includes a base which has a concave or dished out upper surface 34 that is ideally suited to receive the ACOG scope 30. The mount includes a side plate 33, which includes a radiused sidewall slot 62. The mount 31 is affixed to a rifle (not shown) via a sidewall slot 62 which allows a camming screw 36 to engage the left side of a rifle ("left side", from the perspective of the shooter, when aiming the rifle). The camming screw 36 runs through a camming knob 38 with integral camming tab (or handle). The camming screw 36 mates with a manufacturer-provided threaded bore 36" in the left side of the rifle's receiver, just above a longitudinal groove 60' (best seen in FIG. 6). When installed, mount 31 also contacts the rifle by adjustment of a top hexagon socket screw 40 that bears down on the receiver's crown, and block retaining screws 46 that engage a Picatinny tail block 50 located in the space voided by the stripper clip guide 80. The adjustment of top hex screw 40 is secured by tightening a transverse hex socket set screw 42 received in a mount threaded transverse bore 42' located on the right side of the rifle ("right side" from the perspective of the shooter, when aiming the rifle).

Scope 30 is attached to the upper surface 34 of the mount 31 via scope retaining screws 48. It should be noted that proximal end of the scope 30 is the end carrying the ocular lens 32 facing the shooter when aiming the rifle.

It should be noted that "quick release" of mount 31 is attained by allowing the user access to camming screw 36 and block retaining screws 46L, 46R even with the ACOG or other accessories affixed to the mount's upper surface 34. In this regard, the scope 30 and mount 31 my be removed from the rifle via only three screws, namely, camming screw 36, left side screw 46L and right side screw 46R, and the mount 31 and scope 30 may then be reattached without the necessity of recalibrating or re-zeroing the scope 30.

Figure 3:
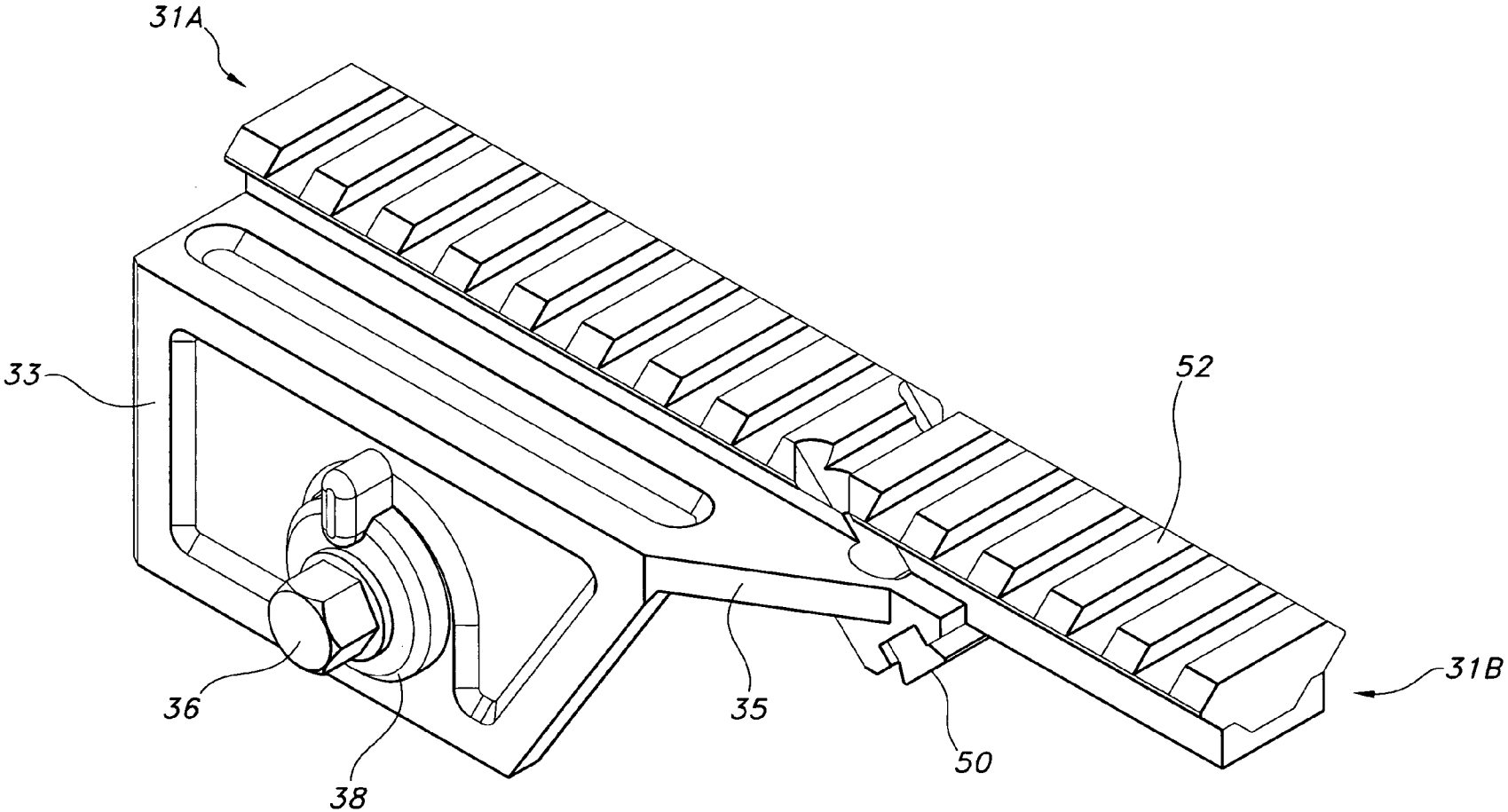
FIG. 3 is a perspective view illustrating the left-side of the mount assembly, in accordance with the present invention.
Figure 17A:
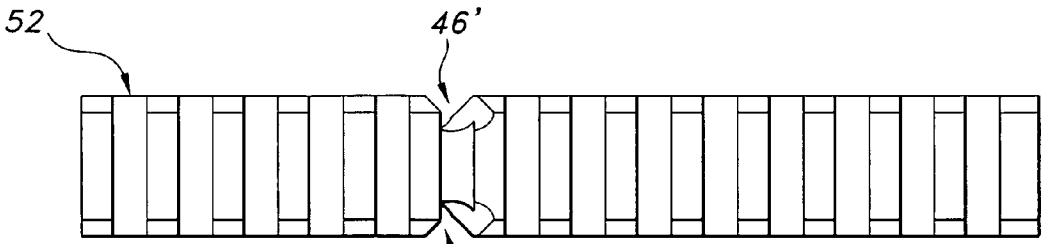
FIG. 17A is a top view in elevation of the accessory Picatinny rail, in accordance with the present invention.
Figure 17C:
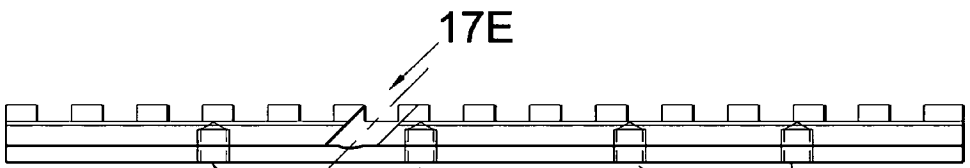
FIG. 17C is a right-side view of the accessory Picatinny rail, in accordance with the present invention.
Figure 17D:
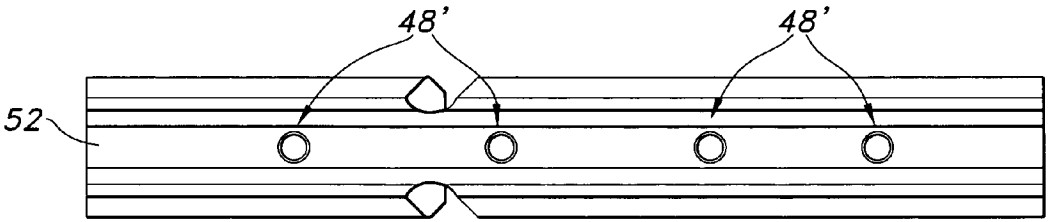
FIG. 17D is a bottom view of the accessory Picatinny rail, in accordance with the present invention.
Figure 17B:
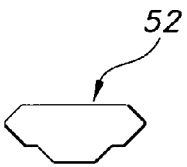
FIG. 17B is an end view of the accessory Picatinny rail, in accordance with the present invention.
Figure 17E:
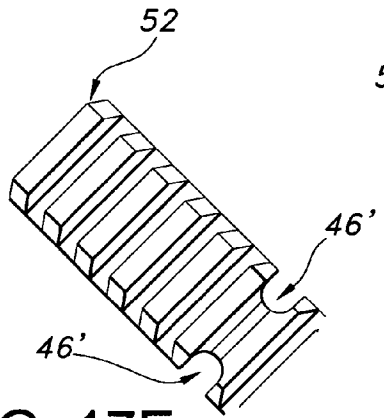
FIG. 17E is a perspective view of the accessory Picatinny rail, detailing block retaining screw cut-outs of the rail, in accordance with the present invention.

FIG. 3 is a perspective view of mount 31 in another embodiment including an optional detachable Picatinny rail 52 adapted to allow the shooter to attach numerous military or commercial scopes or accessories, such as night vision devices, lights, laser pointers or other accessories. The upper surface 34 of the mount is purpose built for the standard ACOG (which has a bottom surface originally designed to fit the M-16 (M-16A1 or A2) in that rifle's carry handle) and the mount's Picatinny rail 52 has a bottom surface dimensioned to engage upper surface 34 (as best seen in FIGS. 17*b* and 17*d*).

Figure 4:
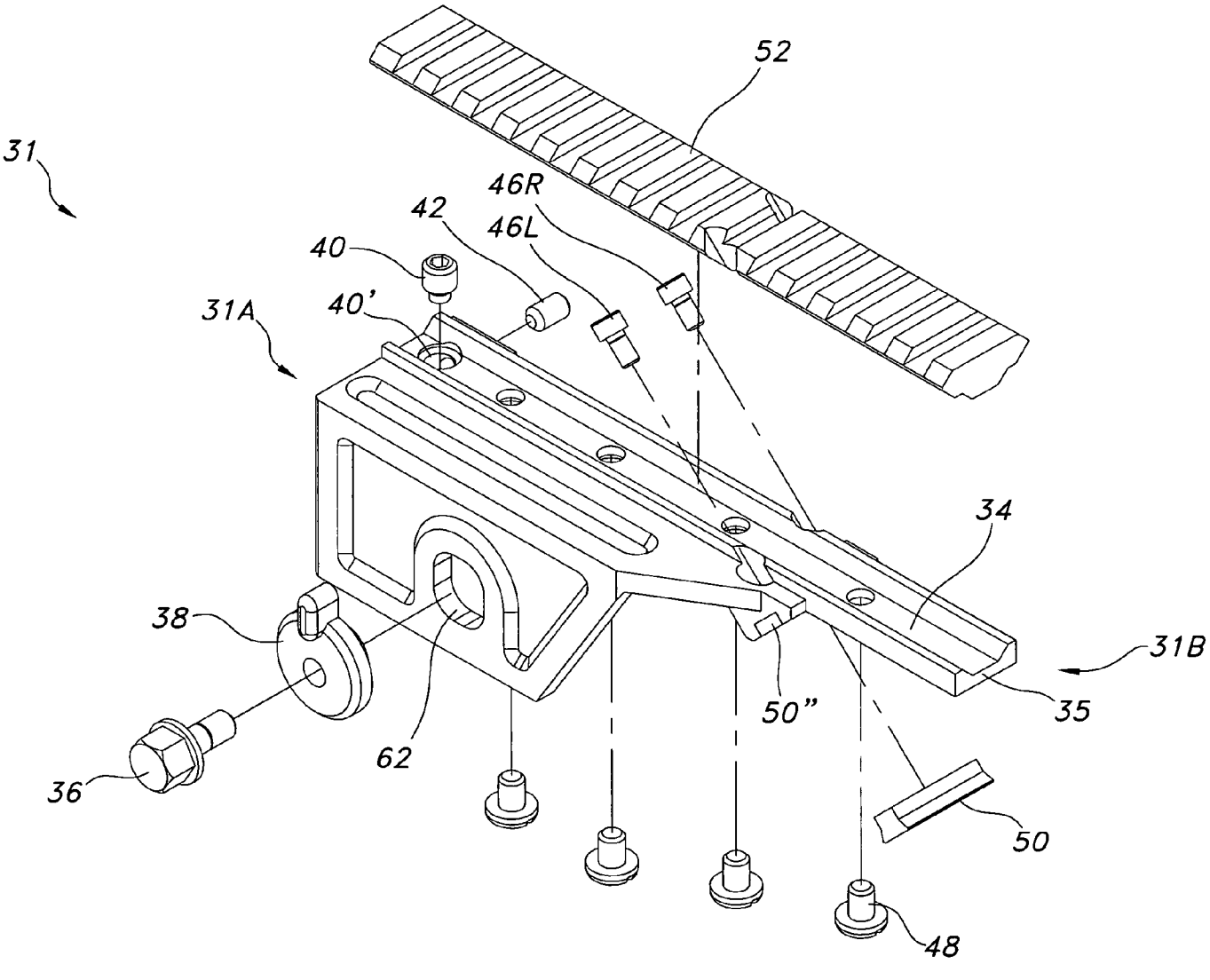
FIG. 4 is an exploded perspective view illustrating the mount assembly with an accessory picatinny-style rail, in accordance with the present invention.
Figure 5:
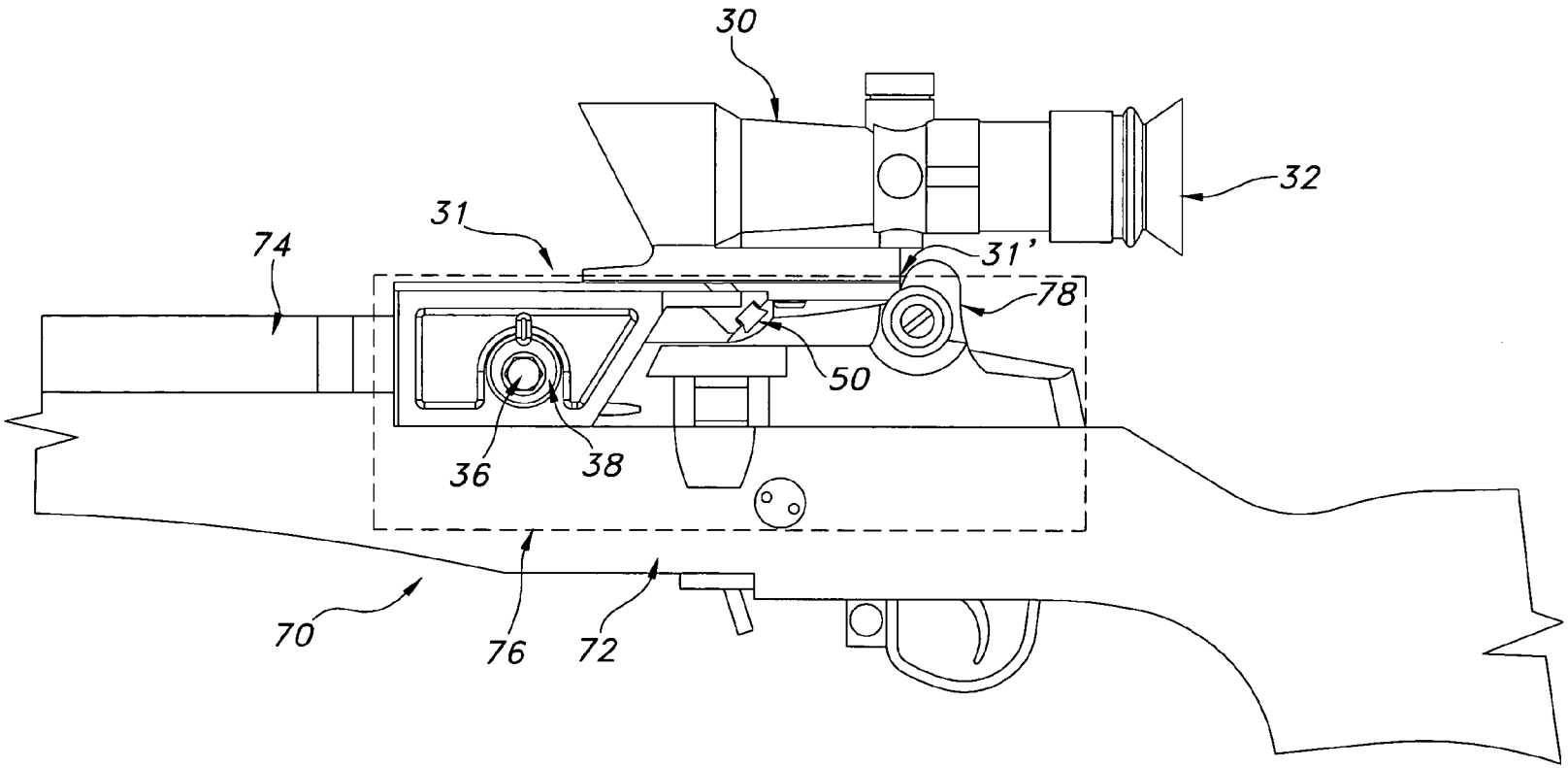
FIG. 5 is a left-side view, in elevation, of a production M-1A/M-14 rifle, with scope and mount, in accordance with the present invention.

Referring now to FIGS. 2, 3 and 5, the rear or proximal end 31B of mount 31 is removably supported on the rifle's receiver 72 by a transverse tail block 50 which is snugly held in transverse mount proximal notch 50" (after removal of the standard stripper clip guide 80). A tapered elongate steel tail block 50 (shown in FIGS. 2, 4, 5, 7*b*, 7*d*, 8*c*, 8*e*, 16*a* and 16*b*) has first and second threaded bores adapted to receive and retain left side screw 46L and right side screw 46R. Optionally, tail or guide block 50 is fastened to mount base 35 by a single threaded fastener (e.g., 46L). Tail block 50 (shown in FIGS. 4 and 5) slides into the rifle's transverse notch or block cut-out area 50' (indicated by a dashed area in FIG. 6) and the proximal or rear end of mount 31 is secured to the rear of the rifle's receiver 72 by tightening left side screw 46L and right side screw 46R.

FIG. 4 is another exploded 3-dimensional depiction of the mount 31 with a set of four scope screws 48 (as opposed to just two scope crews 48 for use with the ACOG) which may be used to attach optional Picatinny rail 52 to the upper surface 34 of mount 31.

FIG. 5 illustrates mount 31 when attached on a rifle 70. The mount 31 is affixed to the rifle's receiver area 72, located at the proximal end of the rifle barrel 74. It should be noted that the mount 31 is mounted in a cantilevered configuration such that the proximal end of the mount 31' is substantially adjacent to or nearly touching the iron sights 78 of rifle 70. This cantilevered configuration allows the proximal end of the scope 32 to be located closer to the shooter's eye (not shown), and so is well suited for use with limited eye-relief optical devices or scopes such as the ACOG. Preferably, the proximal end 31' of mount 31 does not interfere with the rifle's rear sights 78.

When the mount 31 is attached and tightened down (using screws 36, 40, 46L and 46R), the contact points between the mount and the rifle's receiver are (a) at the camming knob screw 36, (b) the tenon 60 which knob screw 36 forces in, (c) the top hex screw 40 at the front or distal end 31A which bears down on the crown of the receiver, and (d) block 50 received in mount's transverse notch 50" in the mount's base and bearing against receiver 72, while placing tension against the angled surfaces of the rifle receiver's transverse notch 50'.

Figure 6:
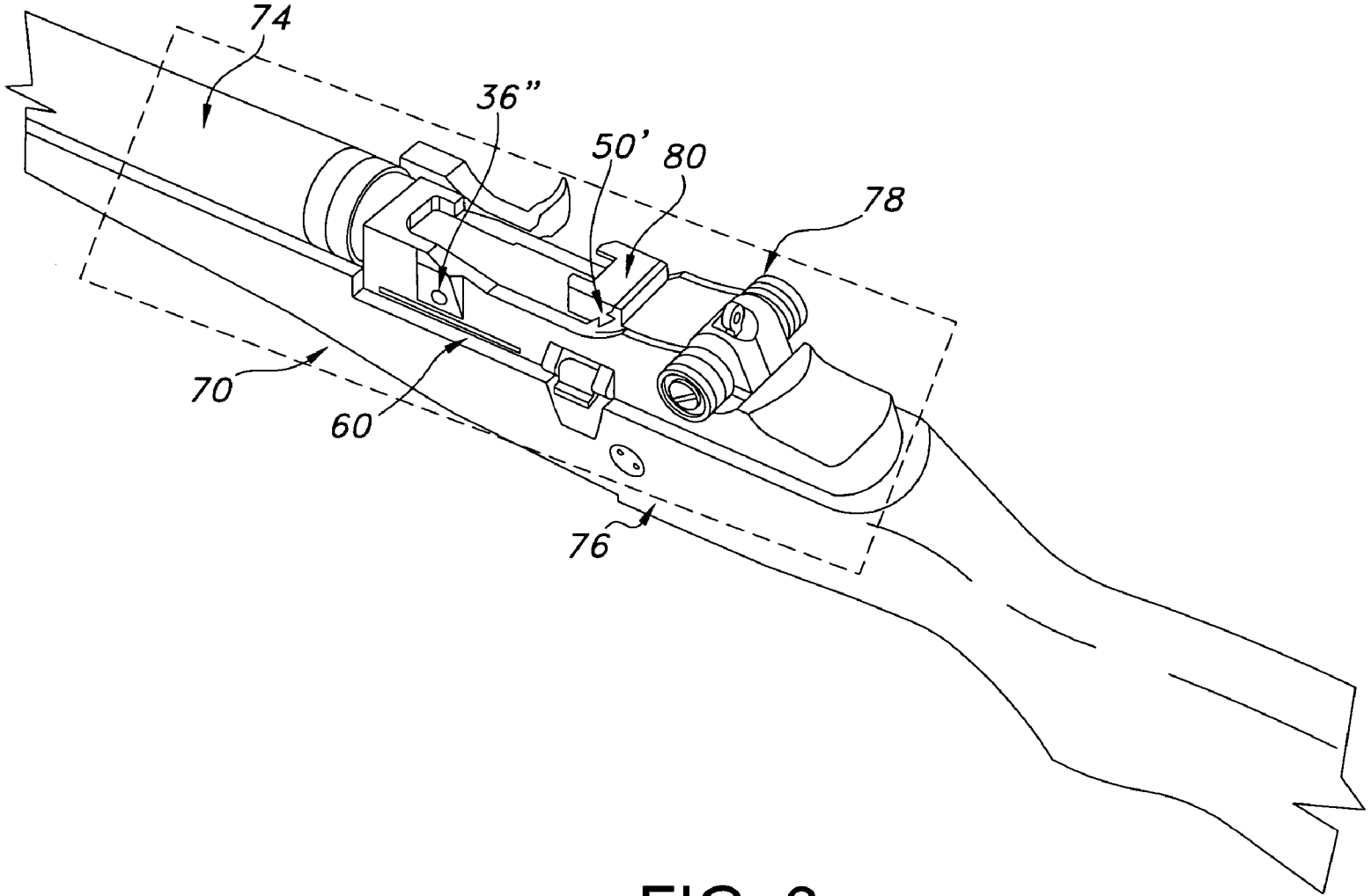
FIG. 6 is a left-side perspective view illustrating the receiver of a production M-1A/M-14 rifle.
Figures 7A, 7B, 7C, 7D, 7E, 7F:
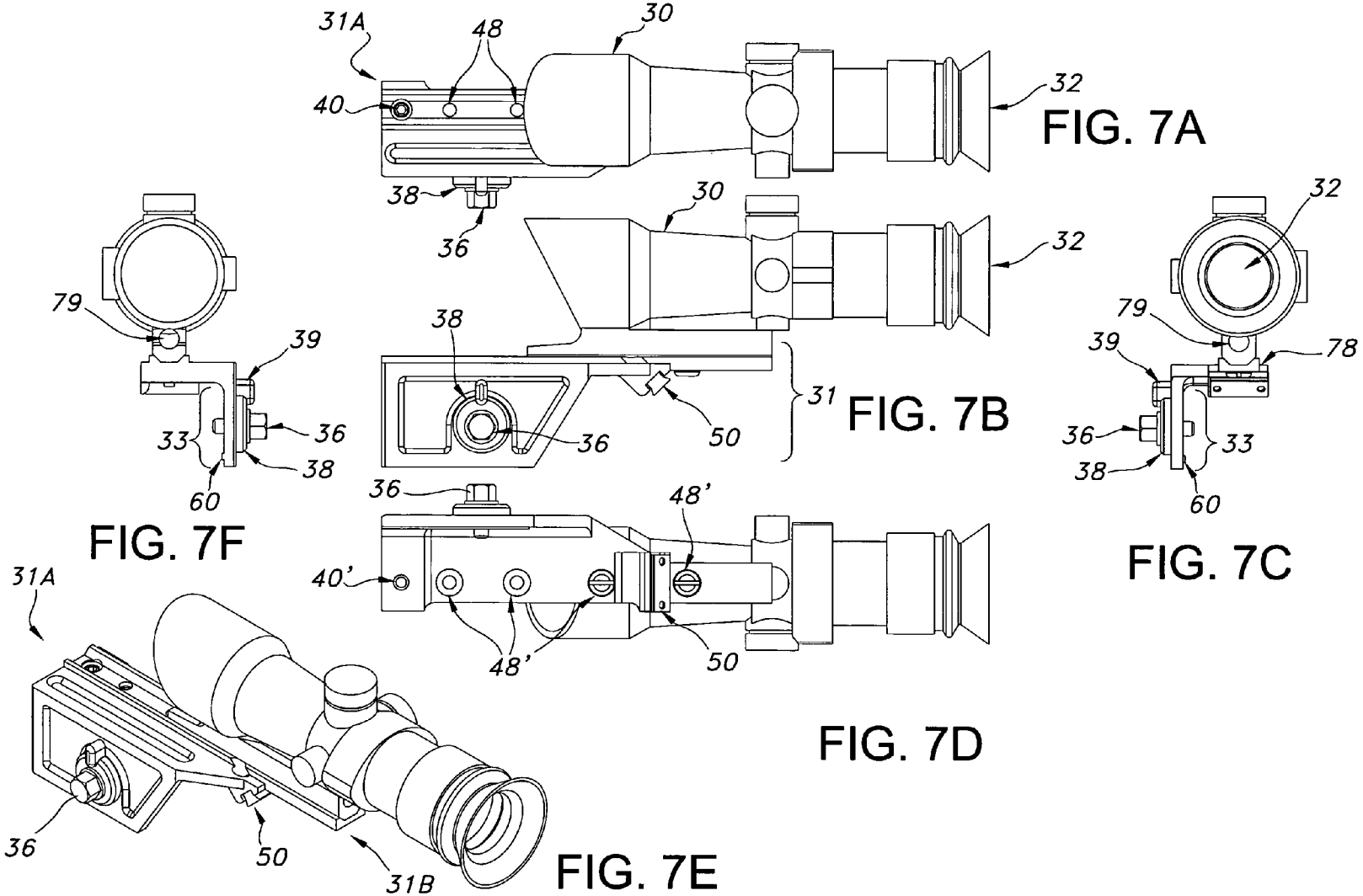
FIG. 7A is a top view in elevation of the mount assembly with scope of FIG. 1, in accordance with the present invention.
FIG. 7B is a left-side view of the mount assembly, with scope, in accordance with the present invention.
FIG. 7C is a rear or proximal end view of the mount assembly, with scope, in accordance with the present invention.
FIG. 7D is a bottom-view of the mount assembly, with scope, in accordance with the present invention.
FIG. 7E is a is a perspective left-side view of the mount assembly, with scope, in accordance with the present invention.
FIG. 7F is a barrel end, front or distal end view of the mount assembly, with scope, in accordance with the present invention.
Figure 8A:
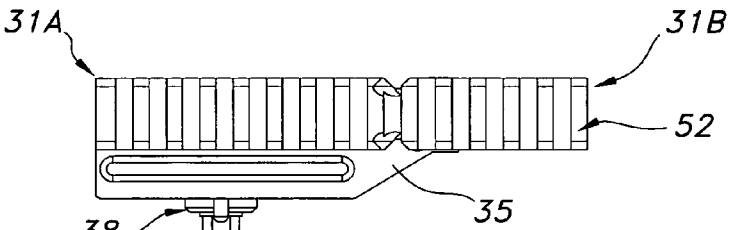
FIG. 8A is a top view in elevation of the mount assembly, in accordance with the present invention.
Figure 8D:
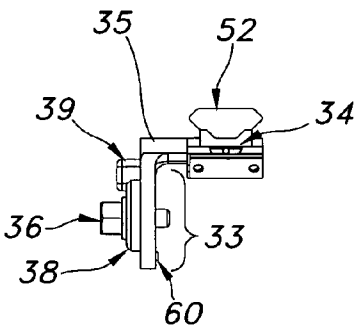
FIG. 8D is a rear or proximal end view of the mount assembly, in accordance with the present invention.
Figure 8C:
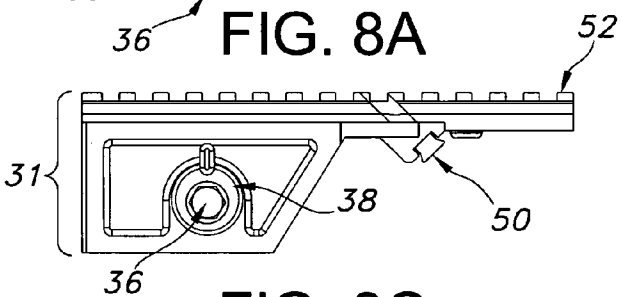
FIG. 8C is a left-side view of the mount assembly, in accordance with the present invention.
Figure 8E:
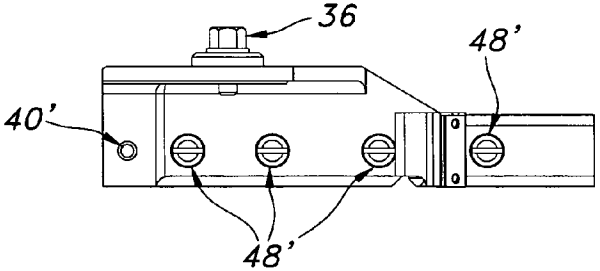
FIG. 8E is a is a bottom view of the mount assembly, in accordance with the present invention.
Figure 8B:
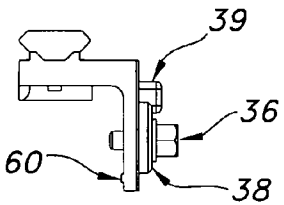
FIG. 8B is a barrel end, front or distal end view of the mount assembly, in accordance with the present invention.
Figure 8F:
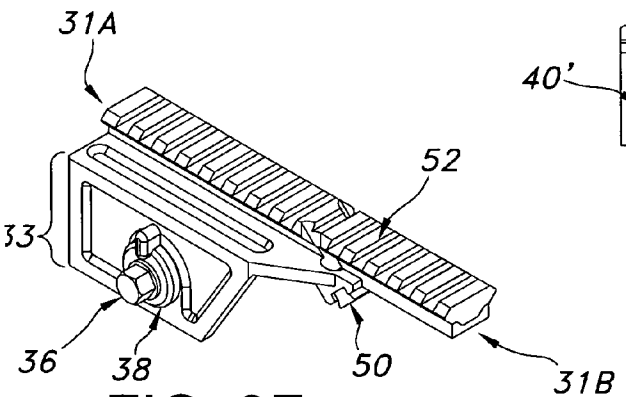
FIG. 8F is a left-side perspective view of the mount assembly, in accordance with the present invention.

FIG. 6 depicts the left side of a standard M-14 or M-1A rifle, before attachment of mount 31. The receiver's relief cut or longitudinal groove 60' indicated in this figure is a pre-existing rifle groove that receives raised ridged tenon 60 (shown in FIGS. 7*c*, 7*f*, 8*b*, 8*d*, 9*b*12*a* and 12*b*) of mount 31. In order to attach mount 31 to rifle 70, the stripper clip guide 80 is drifted to one side and removed from rifle 70 such that tapered tail block 50 can be transversely inserted to slide laterally into the rifle's block cut-out area or transverse notch 50'. Following the removal of the stripper clip guide 80, the user places the mount up against the side of the receiver at the same time pulling upward and in on the groove 60' such that mount tenon 60 engages or bites into the receiver's groove's sidewall.

The mount's tenon 60 (shown in FIGS. 7*c*, 7*f*, 8*b*, 8*d*, 9*b*12*a* and 12*b*) is an elongate raised wall or ridge, rectangular in section and longitudinally aligned so that it is roughly parallel to the rifle's bore and the tenon 60 engages and when tightened by camming screw 36 and camming knob 38 so that tenon 60 bears snugly against an interior surface within the groove 60' in the side of the rifle's receiver. By moving the camming eccentric member 38, one can first get tenon 60 down into the receiver's groove 60' and then snug it up against the side of the receiver.

Next, top hexagon socket screw 40 is tightened to exert force on the top of the receiver to place the mount in a stressed condition by bearing down against the crown of the receiver. The hex socket set screw 40 has a half dog point (i.e., is basically flat and not tapered) and so has as essentially transverse substantially planar surface that does not have a point or radiused tip, and so the entire cross sectional area of screw 40 is at the end surface and when tightened, bears against the top hex screw 40 to prevent a change in the mount's stressed condition.

FIGS. 7*a*-7*f* illustrate top, bottom, side and perspective views of the mount 31 and attached scope 30. The front and rear views of FIGS. 7*f* and 7*c* more clearly depict the mount's side plate 33 and the raised ridged tenon 60, located on the inside of the plate, to engage the relief cut or longitudinal groove 60' of the rifle's receiver.

Mount 31 partially occludes the sight line used when aiming with standard issue iron sights 78 of the M-1A/M-14, although mount 31 is readily released so that one can remove the mount 31 and scope 30 as a unit. Referring to the front view of FIG. 7*f*, the mount does permit limited use of the iron sights 78 through the sighting channel because the base of the peep channel 79 in the ACOG is a rounded axial bore.

FIGS. 8*a*-8*e* illustrate views of mount 31 with the optional Picatinny rail 52 attached. It should be noted that the mount 31 includes four scope screw holes 48' that allow scope screws 48 to affix the Picatinny rail 52 to the mount 31. The bottom view also depicts the threaded bore 40' for the top hexagon socket screw 40 (not depicted in this drawing) running vertically through upper support 34.

Referring to the exploded views of FIGS. 2 and 4, knob screw 36 and camming knob 38 engage and retain the vertical left-side wall 33 of the mount 31. The mount 31 is releasably attached to rifle 70 by first removing the stripper clip guide 80 from the receiver 76 (best depicted in FIG. 6). The Picatinny tail block 50 then has to be fitted (i.e., filed-down, or otherwise formed), since it is preferably initially a little bit oversized when included as part of a kit (including everything shown in FIGS. 2 and 4). Next, a user puts the mount onto the rifle, attaching first and second spaced apart block retaining screws or hexagon socket head cap screws 46L, 46R, spaced to avoid interfering with the central sight channel 79. Preferably, the block retaining screws 46L, 46R are left slightly loose or not tightened fully, while the camming knob 38 is placed against the mount and secured with the knob screw 36.

Figure 9B:
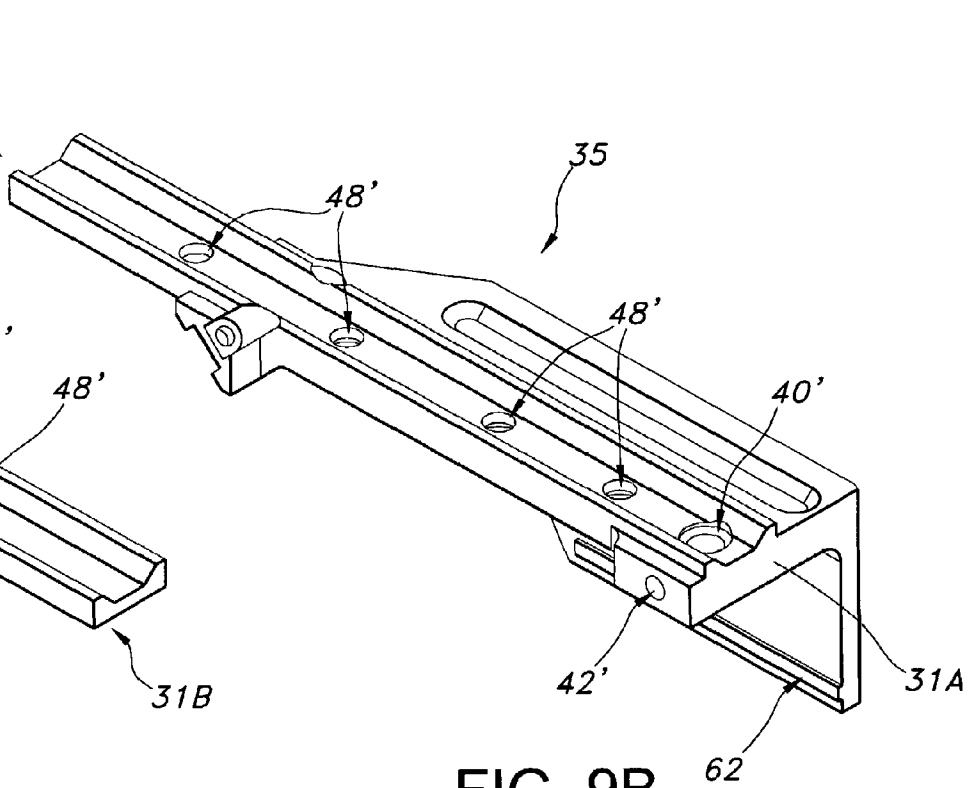
FIG. 9B is a perspective right-side view of the mount base, in accordance with the present invention.
Figure 9A:
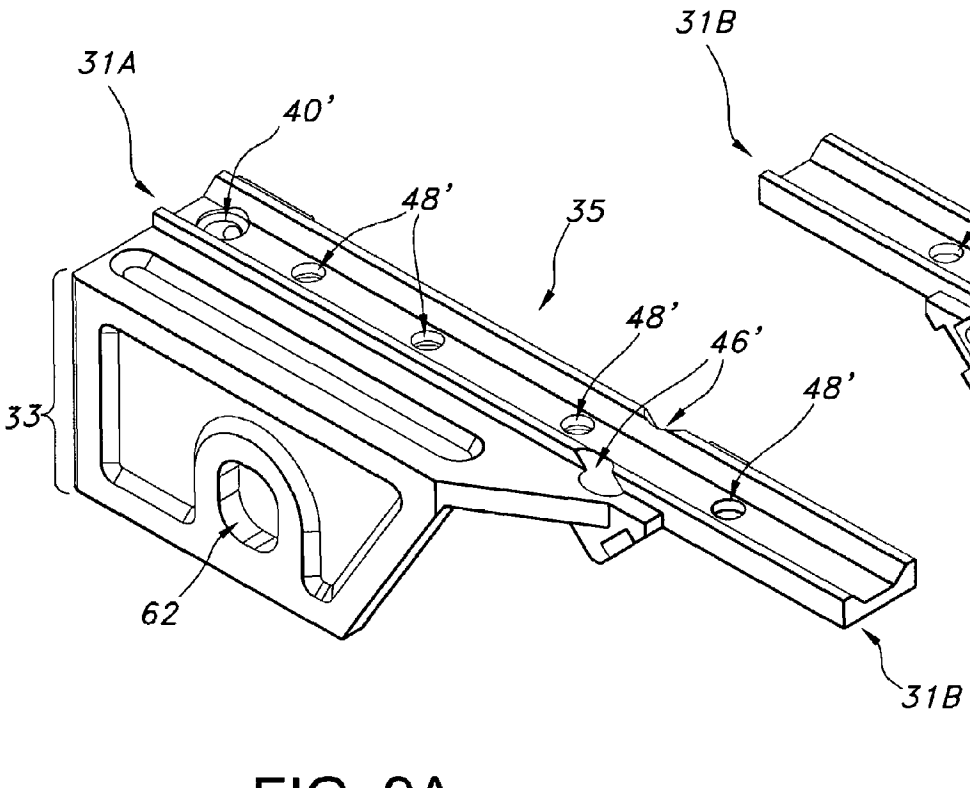
FIG. 9A is a perspective left-side view of the mount base, in accordance with the present invention.

FIGS. 9*a* and 9*b* are left and right side perspective views illustrating the left side and right sides of mount base 35. Mount base 35 is preferably a unitary one-piece cantilever-shaped support member machined or fabricated from a single piece of steel or a similar gunmaking material. Mount base 35 is somewhat "L" shaped, when viewed from the front or rear and has a downwardly depending, substantially planar perpendicular side plate 33 in which is defined a sidewall aperture or slot 62.

The right side view of FIG. 9*b* illustrates the threaded set screw bore 42' for the set screw 42 (shown in FIGS. 2 and 4) that is bored horizontal through the right side of the mount 31. Set screw bore 42' intersects top screw bore 40' in mount body 35. Side hexagon socket set screw 42 acts to exert a force against top screw 40 after top screw 40 is advanced to place compressive stress against the receiver. Camming knob 38 is also adjusted to bear against the side walls of sidewall slot 62 such that the tenon 60 fits snugly within the longitudinal groove 60'. The right side view of FIG. 9*b* also more clearly depicts the rectangular shape of the raised ridged tenon 60 on the inner side of the mount's side plate 33.

Figure 10:
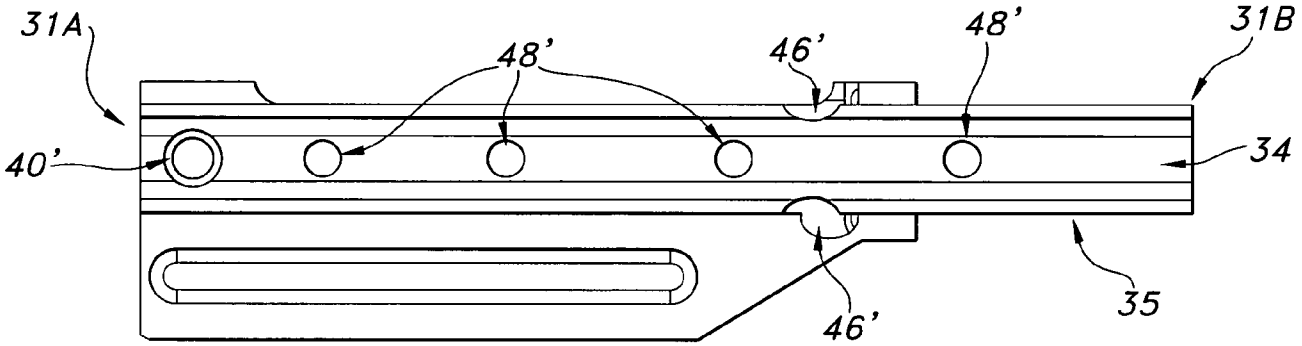
FIG. 10 is a top view in elevation of the mount base, in accordance with the present invention.

FIG. 10 is a top view of the mount base 35. The bores or holes 48' for the pair of proximal scope screws are located 1.25 inches apart, and they are 0.2 inches in diameter, to accommodate the scope screw spacing and size of the ACOG. The threaded bore or hole 40' accommodating the top hexagon socket screw 40 (not shown) has a preferred diameter of 0.1575 inches.

Figure 11:
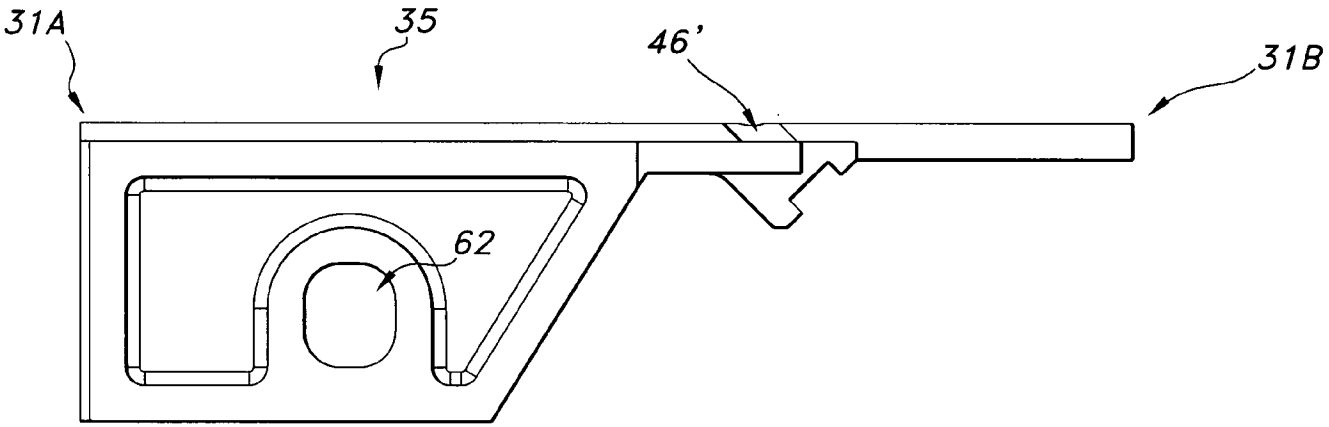
FIG. 11 is a left-side view of the mount base, in accordance with the present invention.

FIG. 11 is a left-side view of the mount 31. The radiused sidewall of slot 62 provides rectangular aperture with radiussed or rounded corners, and provides a bearing surface adapted to engage the eccentric cam 38' of camming knob 38 (shown in FIGS. 15*b* and 15*c*). Note that the holes 46' used to guide the block retaining screws 46 (not shown) into the Picatinny tail block 50 (not shown) are preferably angled at 45 degrees from the axis of mount upper surface 34.

Figure 12B:
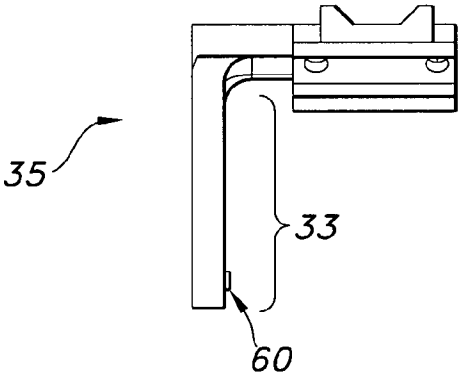
FIG. 12B is a rear view of the mount base, in accordance with the present invention.
Figure 12A:
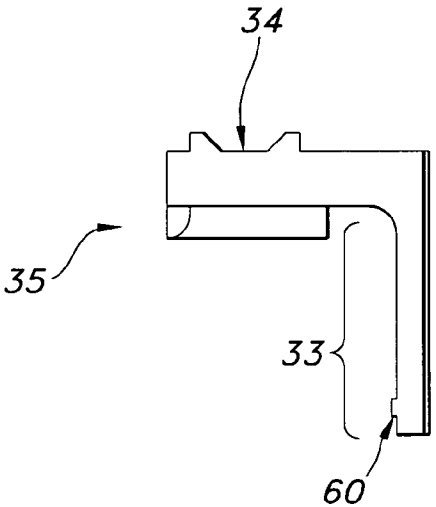
FIG. 12A is a front view of the mount base, in accordance with the present invention.

FIGS. 12*a* and 12*b* illustrate front and rear views of mount base 35. As noted above, mount base 35 is preferably a unitary one-piece shaped-shaped support member machined or fabricated from a single piece of steel or a similar gunmaking material. Mount base 35 is somewhat "L" shaped, when viewed from the front (as in FIG. 12*a*) or rear and has the downwardly depending, substantially planar perpendicular side plate 33 in which is defined the sidewall aperture or slot 62. Dished out or concave upper surface 34 preferably defines 45-degree inwardly sloped surfaces.

Figure 13:
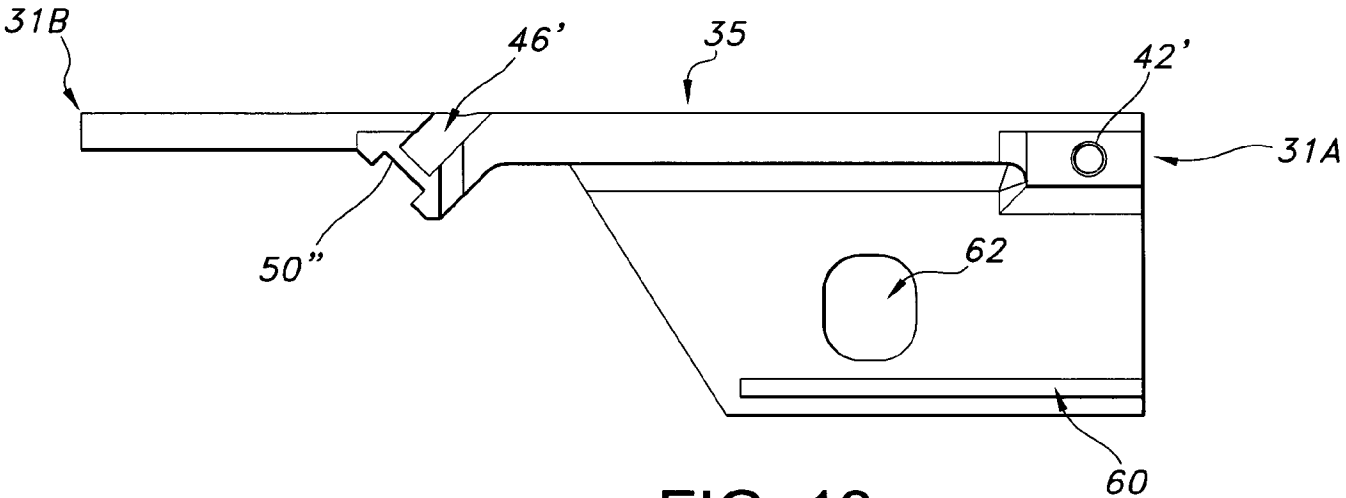
FIG. 13 is a right-side view of the mount base, in accordance with the present invention.

FIG. 13 is a left-side view of the mount base 35. The raised ridged tenon 60 is 2.175 inches long, to conform to the tolerances of the M-14 and/or M-1A relief cut or longitudinal groove 60' (shown in FIG. 6) on rifle 70.

Figure 14C:
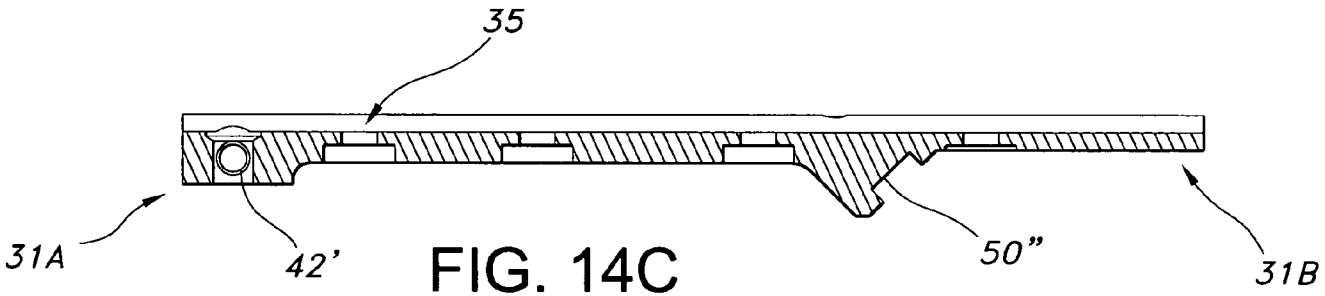
FIG. 14C is a cross section taken along the line B-B of the mount base shown in FIG. 14A, in accordance with the present invention.
Figure 14B:
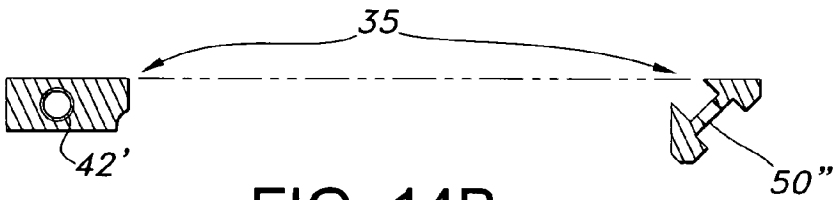
FIG. 14B is a cross section taken along the line A-A of the mount base shown in FIG. 14A, in accordance with the present invention.
Figure 14A:
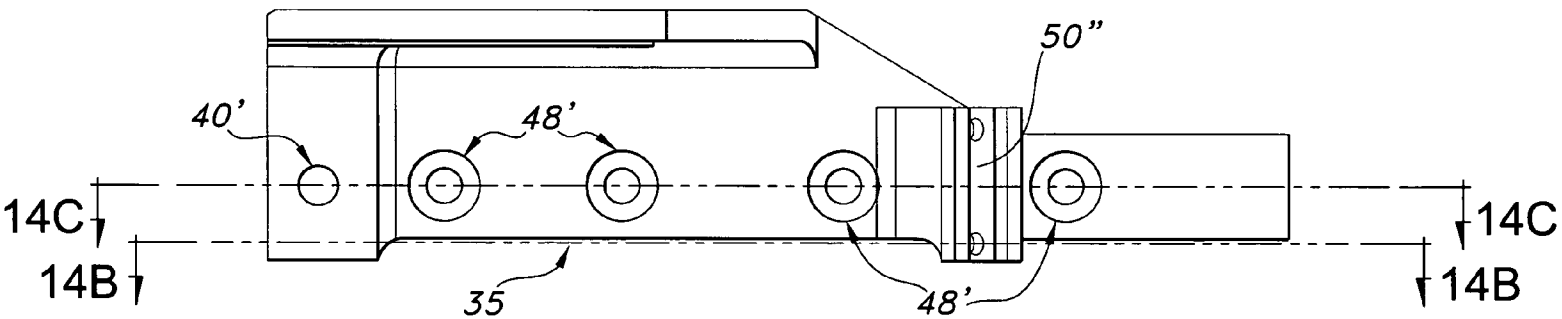
FIG. 14A is a bottom side view of the mount base, in accordance with the present invention.

FIG. 14A is a bottom view of mount base 35, showing section lines A-A and B-B. FIG. 14B shows the cross section of mount base 35 taken along line A-A and FIG. 14B shows the cross section of mount base 35 taken along line B-B.

Figure 15C:
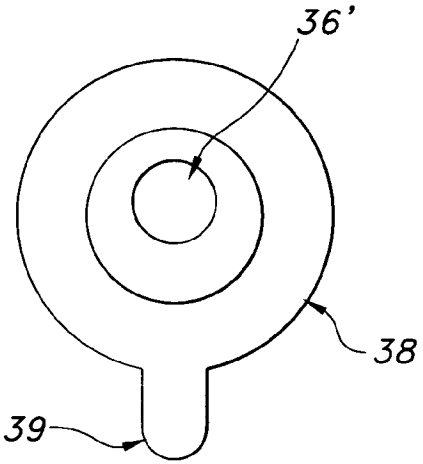
FIG. 15C is a detailed right side, bearing surface side or back view of the camming knob, illustrating the eccentric offset of the bore from the bearing surface, in accordance with the present invention.
Figure 15B:
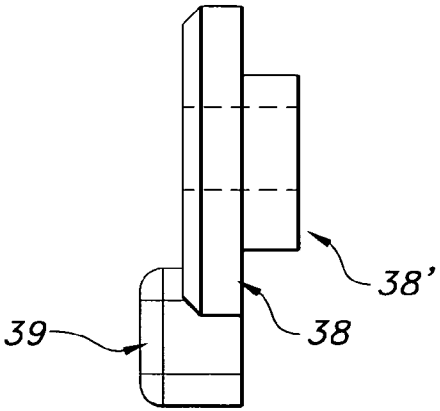
FIG. 15B is a detailed edge view of the camming knob, illustrating the eccentric offset of the bore from the bearing surface, in accordance with the present invention.
Figure 15A:
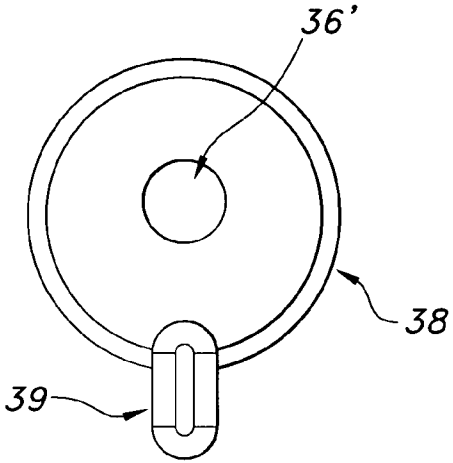
FIG. 15A is a detailed left side view of the camming knob, illustrating the eccentric offset of the bore, in accordance with the present invention.

FIGS. 15A-15C illustrate three views of camming knob 38. The knob 38 has an off-center, or eccentric, bore or aperture 36' sized to slidably accommodate the camming screw 36 (not shown) which serves as an axle for rotation of eccentric or cam 38'. The knob 38 also includes a camming tab or handle 39, providing the user with leverage to manipulate the knob 38 during the iterative tightening and camming of the camming knob 38 and camming screw 36.

The camming knob 38 carries cam 38' that provides lateral force with a camming action. It is a sideways bearing cam. Looking at the views of FIGS. 17B and 17C, one can see where the thru-hole is not centered in the circular periphery, such that as the user twists the handle, the inwardly projecting cam surface 38' bears against the base sidewall's slot 62. The sidewall slot 62 has radiused corners, such that when a user screws in the side cam screw 36 and then grasps the knob 38 and rotates it one way or another, the raised ridged tenon 60 of the mount's side plate 33 is forced back and into the relief cut or longitudinal groove 60' on the left-side of the rifle. This camming or clamping action takes out any parallel or side-to-side play in mount 31 when properly adjusted on rifle 70. As the user installs and tightens the mount, the user first tightens the side screw 36 and then uses the camming knob 38, in an iterative manner, to remove any remaining play prior to further tightening of the side screw 36. The sidewall slot 62 is shaped in such a manner as to ensure the eccentric movement of the camming knob 38, which in turn moves the left mount side plate 33 upwardly, downwardly, distally towards the barrel or proximally toward the shooter.

Figure 16B:
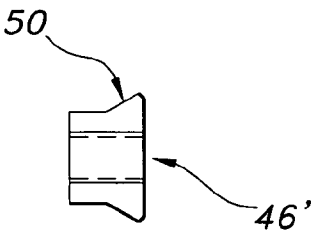
FIG. 16B is a detailed cross-sectional view of the guide block, in accordance with the present invention.
Figure 16A:
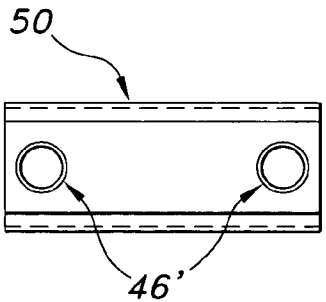
FIG. 16A is a detailed side view of the guide block, in accordance with the present invention.

FIGS. 16A and 16B illustrate of the mount's tapered tail block 50. Block 50 is dimensioned to fits into the rifle's transverse notch 50' (of FIG. 6, once the stripper clip guide 80 is removed). It should be noted that this block has a preferred length of 0.85 inches, and a cross-sectional tapered shape as depicted in the drawing, to conform to the shape and tolerances of the M-14 and M-1A. During initial fitting, there may be a need to shape or file the block 50 to fit the exact shape of the rifles transverse notch 50', as the dimensions of block 50 are preferably initially slightly oversized, to permit the user to custom fit the tail block 50 to his rifle's transverse notch 50'. Once block 50 is uniquely fitted to the rifle's notch 50', block 50 is attached to mount base 35 via threaded block retaining screws 46L, 46R which may then be tightened to force block 50 to contact and fit snugly within transverse mount proximal notch 50".

This combination provides a three point lock up, the three points being (1) on the left side of the rifle (tenon/bolt), (2) proximally at the tail block 50, and (3) the front screw 40, which bears on the receiver's crown, when tightened.

FIGS. 17A-17E illustrate top, bottom, side and end views of the optional Picatinny rail 52. Rail 52 has a 45-degree convex-shape defining the bottom engagement surface which is adapted to mate with the dished-out or concave upper surface 34 of the mount.

The mount of the present invention provides a centrally aligned support placed well to the rear for use with sights having very limited eye relief, and so is especially well suited for use with the ACOG and similar optical sights.

Other mounts not providing this centrally aligned rearward support are likely to require the shooter to place his or her head farther forward on the stock, where the abrupt rearward movement of recoil may cause an injury.

It will be appreciated by those of skill in the art that the removable optical sight mount is adapted for use with military-style rifles such as an M1A and makes available a mount 31 including a one-piece mount base 35 having a substantially planar vertical side wall 33 carrying an elongated upper support segment defining a support surface 34 where the vertical side wall 33 has exterior surface opposing an interior surface carrying an inwardly projecting longitudinal tenon 60 dimensioned to fit within a longitudinal groove 60' defined in the rifle's receiver 76. The sidewall 33 has a first aperture 62 that is square shaped but with radiused corners there thru, and the aperture is defined within an aperture interior surface; the annular eccentric camming knob 38 receives a first threaded fastener 36 there thru and has an inwardly projecting camming side surface 38' adapted to exert force against said sidewall aperture's interior surface when first threaded fastener 36 is threadably attached to the rifle's receiver.

Mount 31 has a distal end 31A and a proximal end 31B and has a first threaded bore 40' defined vertically proximate the mount's distal end 31A and carrying a second threaded fastener 40 in the mount's first threaded bore 40'. Mount 31 also carries a rear support or guide block 50 spaced at a selected distance from the mount's proximal end 31B, and the mount provides a three point attachment to the rifle, the three points being (a) tenon 60 engaging the groove 60' on the side of the rifle, (b) rear support 50, and (3) the forward fastener 40 bearing on the receiver's crown. With this combination of supporting and fastening elements, the mount provides a removable, centrally aligned supportive base projecting proximally for use with sights having very limited eye relief.

Having described preferred embodiments of a new and improved method, it is believed that other modifications, variations and changes will be suggested to those skilled in the art in view of the teachings set forth herein. It is therefore to be understood that all such variations, modifications and changes are believed to fall within the scope of the present invention.

What is claimed is:

1. A removable mount adapted for use with a rifle, comprising:

a horizontal longitudinal rectangular base carrying an upper support segment having a horizontal concave upper surface, said base having a distal end and a proximal end;

a vertical side wall attached to said base, said vertical side wall projecting downwardly from said base and having an interior surface and exterior surface;

said interior surface of said vertical side wall having an inwardly projecting longitudinal tenon dimensioned to fit within a longitudinal groove defined in the rifle's receiver;

said vertical side wall adapted to receive a first threaded fastener there thru, said first threaded fastener adapted to engage the rifle's receiver;

wherein said vertical side wall has an aperture running there thru, said aperture defining an interior bearing surface;

an annular eccentric cam being carried on and rotatable about said first threaded fastener when said first threaded fastener projects through said side wall's aperture, said annular eccentric cam having a camming surface configured to releasably exert a force against said aperture's interior bearing surface and to force, thereby, said inwardly projecting longitudinal tenon into a snug engagement with said longitudinal groove defined in the rifle's receiver;

a guide block dimensioned to be transversely mounted on a rifle's receiver within a proximal transverse notch; and said guide block being attached to said proximal end of said base by at least one block retaining screw.

2. The removable mount of claim 1, wherein said vertical side wall aperture is configured as a radiussed slot wherein said sidewall slot's interior bearing surface is configured to allow a user to exert a camming force with said annular eccentric cam to move the side plate in a selected direction, and wherein said direction is selected from upwardly, downwardly, distally or proximally;

wherein said removable mount's sidewall is thereby configured to force said inwardly projecting longitudinal tenon into a snug engagement with said longitudinal groove defined in the rifle's receiver and to minimize side-to-side play between said removable mount and said rifle.

3. The removable mount of claim 2, wherein the first threaded fastener mates with a rifle manufacturer-provided threaded bore in the rifle's receiver, said receiver bore being located above the receiver's longitudinal groove.

4. The removable mount of claim 2, wherein said distal end of said base has a vertical threaded bore defined therethrough, said vertical bore being adapted to allow a second threaded fastener to contact and exert pressure on the crown of a rifle's receiver.

5. The removable mount of claim 4, wherein said distal end of said base has a horizontal threaded bore defined horizontally therethrough, said horizontal bore being located on the side of the base opposing the vertical side wall and intersecting said vertical bore to allow a third threaded fastener to contact and exert pressure on said second threaded fastener, thereby providing a set screw for said second threaded fastener.

6. The removable mount of claim 1, wherein said upper support segment has at least two threaded bore holes, said upper support bore holes being adapted to receive fasteners for affixing accessories to the upper support.

7. The removable mount of claim 6, wherein said upper support bore holes comprise two holes 0.2 inch in diameter and spaced 1.25 inches apart, and used to affix an ACOG scope to said upper support.

8. The removable mount of claim 6, wherein said accessories are selected from a group comprising a military optical sight, a commercial optical sight, a Picatinny rail, and a night vision device.

9. The removable mount of claim 8, wherein said first threaded fastener and said block retaining screws are located such that they may be accessed and adjusted while said accessory is affixed to said upper support.

10. The removable mount of claim 6, wherein said upper support bore holes comprise four holes used to affix a Picatinny rail.

11. A removable mount adapted for use with a firearm having a proximal receiver which carries a distally projecting elongated barrel, comprising:

a longitudinal rectangular base carrying an upper support segment having a concave upper surface, said base having a distal end and a proximal end;

a side plate depending from said base, said side plate projecting perpendicularly from said base and having an interior surface and exterior surface;

said interior surface of said side plate having an inwardly projecting longitudinal tenon dimensioned to fit within a longitudinal groove defined in the receiver;

said side plate adapted to receive a first threaded fastener, there thru, said first threaded fastener adapted to engage the rifle's receiver;

wherein said side plate has an aperture running therethrough, said aperture defining an interior bearing surface; and an annular eccentric cam having a camming surface configured to releasably exert a force against said aperture's interior bearing surface and to force, thereby, said inwardly projecting longitudinal tenon into a snug engagement with said longitudinal groove defined in the receiver.

12. The removable mount of claim 11, wherein said side plate aperture is configured as a radiussed slot;

wherein said side plate slot's interior bearing surface is configured to allow a user to exert a camming force with said annular eccentric cam to move the side plate in a selected direction, and wherein said direction is selected from upwardly, downwardly, distally or proximally; and wherein said removable mount's side plate is thereby configured to force said inwardly projecting longitudinal tenon into a snug engagement with said longitudinal groove defined in the rifle's receiver and to minimize side-to-side play between said removable mount and said rifle.

13. The removable mount of claim 12, wherein the first threaded fastener mates with a rifle manufacturer-provided threaded bore in the rifle's receiver, said receiver bore being located above the receiver's longitudinal groove.

14. The removable mount of claim 12, wherein said distal end of said base has a vertical threaded bore defined therethrough, said vertical bore being adapted to allow a second threaded fastener to contact and exert pressure on the crown of a rifle's receiver.

15. The removable mount of claim 14, wherein said distal end of said base has a horizontal threaded bore defined horizontally therethrough, said horizontal bore being located on the side of the base opposing the side plate and intersecting said vertical bore to allow a third threaded fastener to contact and exert pressure on said second threaded fastener, thereby providing a set screw for said second threaded fastener.

16. The removable mount of claim 11, wherein said upper support segment has at least two threaded bore holes, said upper support bore holes being adapted to receive fasteners for affixing accessories to the upper support.

17. The removable mount of claim 16, wherein said upper support bore holes comprise two holes 0.2 inch in diameter and spaced 1.25 inches apart, and used to affix an ACOG scope to said upper support.

18. The removable mount of claim 16, wherein said accessories are selected from a group comprising a military optical sight, a commercial optical sight, a Picatinny rail, and a night vision device.

19. The removable mount of claim 18, further comprising:

a guide block dimensioned to be transversely mounted on a rifle's receiver within a proximal transverse notch; and said guide block being attached to said proximal end of said base by at least one block retaining screw, wherein said first threaded fastener and said block retaining screw are located such that they may be accessed and adjusted while said accessory is affixed to said upper support.

* * * * *